US006459201B1

(12) United States Patent
Schermerhorn et al.

(10) Patent No.: US 6,459,201 B1
(45) Date of Patent: Oct. 1, 2002

(54) FLAT-PANEL DISPLAY WITH CONTROLLED SUSTAINING ELECTRODES

(75) Inventors: Jerry D. Schermerhorn, Perrysburg; Oleksandr Shvydky, Toledo, both of OH (US)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/376,130

(22) Filed: Aug. 17, 1999

(51) Int. Cl.[7] ..... H01J 11/00
(52) U.S. Cl. ..... 313/586; 584/587; 584/610
(58) Field of Search ..... 313/586, 584, 313/587, 610, 612, 634, 113, 611; 345/37, 41, 60

(56) References Cited

U.S. PATENT DOCUMENTS

| | | | |
|---|---|---|---|
| 3,499,167 | A | 3/1970 | Baker et al. |
| 3,559,190 | A | 1/1971 | Bitzer |
| 3,755,027 | A | 8/1973 | Gilsing |
| 3,942,061 | A | 3/1976 | van Esdonk et al. |
| 4,198,585 | A | 4/1980 | Yamashita et al. |
| 4,494,038 | A | 1/1985 | Wedding et al. |
| 4,629,942 | A | 12/1986 | Horio et al. |
| 4,638,218 | A | 1/1987 | Shinoda et al. |
| 4,723,093 | A | 2/1988 | Nolan |
| 4,737,687 | A | 4/1988 | Shinoda et al. |
| 5,086,297 | A | 2/1992 | Miyake et al. |
| 5,144,200 | A | 9/1992 | Kim |
| 5,164,633 | A | 11/1992 | Kim et al. |
| 5,525,862 | A | 6/1996 | Miyazaki |
| 5,541,479 | A | 7/1996 | Nagakubo |
| 5,634,836 | A | 6/1997 | Lepselter |
| 5,661,500 | A | 8/1997 | Shinoda et al. |
| 5,674,553 | A | 10/1997 | Shinoda et al. |
| 5,723,945 | A | 3/1998 | Schermerhorn |
| 5,757,131 | A | 5/1998 | Tsuchiya |

FOREIGN PATENT DOCUMENTS

| | | |
|---|---|---|
| JP | 55179962 | 6/1982 |
| JP | 58153545 | 3/1985 |
| JP | 2671870 | 7/1997 |
| JP | 10-333636 | 12/1998 |
| JP | 10038688 | 8/1999 |
| JP | 10069949 | 10/1999 |

*Primary Examiner*—Ashok Patel
(74) *Attorney, Agent, or Firm*—MacMillan, Sobanski & Todd, LLC

(57) ABSTRACT

A plasma flat-panel display comprising a hermetically sealed gas filled enclosure. The enclosure includes a top glass substrate having a plurality of parallel sustaining electrode pairs deposited upon an interior surface thereof and at least one control electrode associated with each pair of sustaining electrodes deposited upon the interior surface between the associated sustaining electrodes. The enclosure also includes a thin dielectric film covering the sustaining and control electrodes and a bottom glass substrate separated from the top glass substrate. The bottom substrate includes a plurality of alternating barrier ribs and microgrooves. An address electrode is associated with each microgroove and a phosphor is deposited over a portion of each address electrode.

26 Claims, 6 Drawing Sheets

FLAT-PANEL DISPLAY WITH CONTROLLED SUSTAINING ELECTRODES

FIELD OF INVENTION

This invention relates in general to a flat-panel display and in particular to an improved structure for a full color, high resolution capable flat-panel display which operates at a high efficiency.

BACKGROUND OF THE INVENTION

A flat-panel display is an electronic display in which a large orthogonal array of display pixels, such as electroluminescent devices, AC plasma panels, DC plasma panels and field emission displays and the like form a flat screen.

The basic structure of an AC Plasma Display Panel, or PDP, comprises two glass plates with a conductor pattern of electrodes on the inner surfaces of each plate. The plates are separated by a gas filled gap. The electrodes are configured in an x-y matrix with the electrodes on each plate deposited at right angles to each other using conventional thin or thick film techniques. At least one set of sustaining electrodes of the AC PDP is covered with a thin glass dielectric layer. The glass plates are assembled into a sandwich with the gap between the plates fixed by spacers. The edges of the plates are sealed and the cavity between the plates is evacuated and filled with a mixture of neon and xenon gases or a similar gas mixture of a type well known in the art.

During operation of an AC PDP, a sufficient driver voltage pulse is applied to the electrodes to ionize the gas contained between the plates. When the gas ionizes, the dielectrics charge like small capacitors, which reduces the voltage across the gas and extinguishes the discharge. The capacitive voltages are due to stored charge and are conventionally called wall charge. The voltage is then reversed, and the sum of the driver voltage and wall charge voltages is again large enough to excite the gas and produce a glow discharge pulse. A sequence of such driver voltages repetitively applied is called the sustaining voltage, or sustainer. With the sustainer waveform, pixels which have had charge stored will discharge and emit light pulses at every sustainer cycle. Pixels which have no charge stored will not emit light. As appropriate waveforms are applied across the x-y matrix of electrodes, small light emitting pixels form a visual picture.

Typically, layers of red, green or blue phosphor are alternately deposited upon the inner surface of one of the plates. The ionized gas causes the phosphor to emit a colored light from each pixel. Barrier ribs are typically disposed between the plates to prevent cross-color and cross-pixel interference between the electrodes. The barrier ribs also increase the resolution to provide a sharply defined picture. The barrier ribs further provide a uniform discharge space between the glass plates by utilizing the barrier rib height, width and pattern gap to achieve a desired pixel pitch.

Further details of the structure and operation of an AC PDP are disclosed in U.S. Pat. No. 5,723,945 titled "FLAT PANEL DISPLAY"; U.S. Pat. No. 5,962,983 entitled "DISPLAY PANEL HAVING MICROGROOVES AND METHOD OF OPERATION"; and U.S. patent application Ser. No. 09/259,940, filed Mar. 1, 1999, entitled "FLAT-PANEL DISPLAY", all of which are incorporated herein by reference.

SUMMARY OF THE INVENTION

This invention relates to an improved plasma flat-panel display which includes a pair of control electrodes disposed between each pair of sustaining electrodes.

It is known to manufacture plasma flat-panel displays having pairs of sustaining electrodes which establish a charged volume between the display substrates. The charge is controlled by applying voltages to a plurality of address electrodes. The charged volume is established by applying a voltage to the sustaining electrodes. The efficiency of the panel is generally greater when gas and geometry parameters are adjusted to increase the voltage required to sustain a discharge. However, this is in conflict with the need to have low voltages for economic and reliability purposes. Therefore, it would be desirable to develop a compromise device which would allow initiation and control of the sustaining discharge with a less powerful and lower voltage controlling means.

The present invention contemplates a plasma flat-panel display having a first transparent substrate with at least one pair of parallel sustaining electrodes deposited thereupon. A least one control electrode is deposited upon the first substrate parallel to the sustaining electrodes. The panel also includes an charge storage surface coating which covers the sustaining and control electrodes. The charge storage surface is covered by a thin film of electron emissive material. The electron emissive film may be optionally formed in a pattern from materials having differing electron emissive characteristics, for ease of generating secondary emission electrons. The ease of generating secondary emissive electrons for a material is referred to as the "gamma" of the material. The panel further includes a second substrate which is hermetically sealed to the first substrate, the second substrate having a plurality of gas-filled micro-voids formed in a surface thereof which is adjacent to the first substrate. The micro-voids are generally perpendicular to the sustaining and control electrodes and cooperate with the first substrate to define a plurality of sub-pixels. A plurality of address electrodes are incorporated within the second substrate, each of the address electrodes corresponding to one of the sub-pixels.

It is further contemplated that a phosphor material is deposited within each micro-void and associated with the address electrodes. In the preferred embodiment, the first and second substrates are formed from glass. Additionally, the invention can be practiced having a pair of control electrodes disposed between the sustaining electrodes.

The plasma flat-panel also can include a plurality of pairs of sustaining electrodes, each pair of sustaining electrodes having at least one control electrode associated therewith. The micro-voids in the second substrate cooperate with the first substrate to define a plurality of sub-pixels which form rows parallel to the sustaining and control electrodes and columns which are perpendicular to the sustaining and control electrodes with each of the plurality of address electrodes incorporated within the second substrate corresponding to one column of the sub-pixels.

The invention also contemplates a method for operating the above described plasma flat-panel display which includes applying a first voltage to the control electrode of sufficient magnitude to inject a charge of electrons between the control electrode and an associated sustaining electrode. A second voltage is then applied to the sustaining electrodes to cause a discharge therebetween The discharge between the sustaining electrodes can be controlled by applying a third voltage to the address electrodes.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
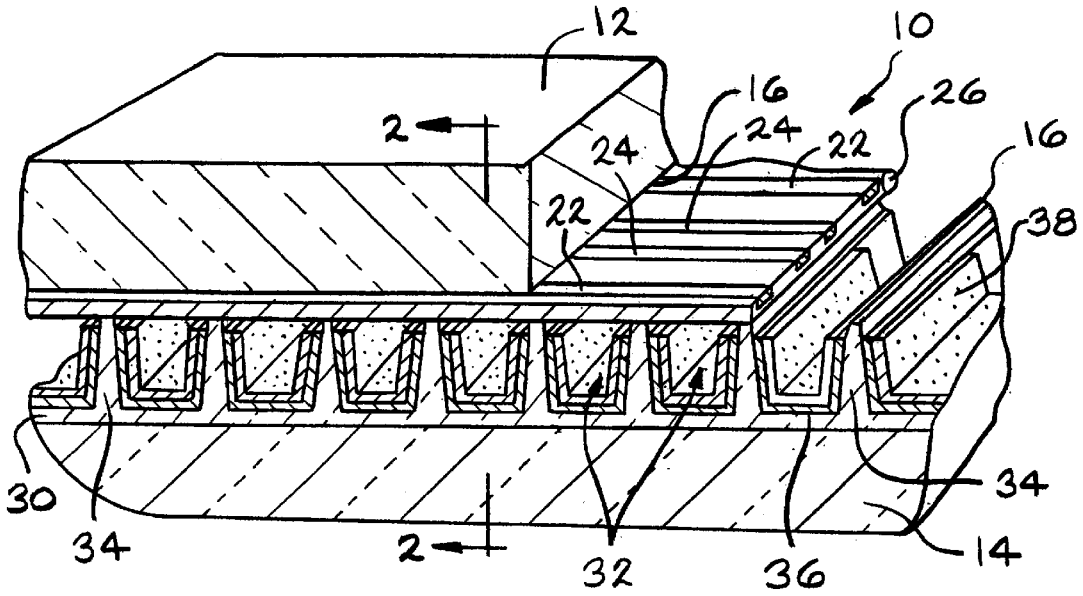
FIG. 1 is a perspective view of a plasma display panel in accordance with the invention.
Figure 2:
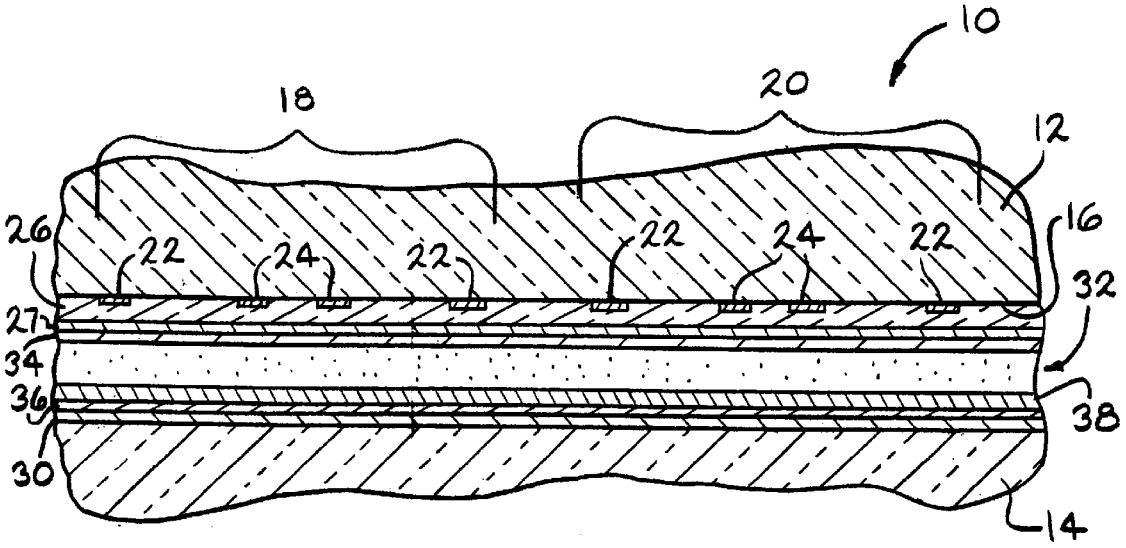
FIG. 2 is sectional view of the plasma display panel in FIG. 1 taken along line 2—2.

Referring now to the drawings, there is illustrated in FIGS. 1 and 2 the structure of an improved plasma display panel (PDP) 10, which, in the preferred embodiment, is an AC PDP. In the following description, like reference characters designate like or corresponding parts. Also, in the following description, it is to understood that such terms as "top", "bottom", "forward", "rearward", and similar terms of position and direction are used in reference to he drawings and for convenience in description.

Generally, the PDP 10 comprises a hermetically sealed gas filled enclosure including a top glass substrate 12 and a spaced bottom glass substrate 14. The top glass substrate 12 is superposed upon the bottom glass substrate 14. The glass substrates 12 and 14 are typically both transmissive to light and of a uniform thickness, although only the viewing side, normally the top substrate 12, is required to be transparent to visible light. For example, the glass substrates 12 and 14 may be approximately ⅛ to ¼ inch thick.

The top glass substrate 12 may contain $SiO_2$, $Al_2O_3$, $MgO_2$ and CaO as the main ingredients and $Na_2O$, $K_2O$, PbO, $B_2O_3$ and the like as accessory ingredients. Deposited upon a lower surface 16 of the top substrate 12 are a plurality of sets of parallel electrodes. One such set, which is labeled 18, is illustrated in FIGS. 1 and 2 while a second set, which is labeled 20, is illustrated only in FIG. 2. Each set of electrodes includes an outer pair of display, or sustainer, electrodes 22, which typically have a spacing of approximately 800 microns. Disposed between each pair of sustainer electrodes 22 are a pair of control electrodes 24, which typically have a spacing within the range of 100 microns to 400 microns. As shown in FIG. 2, the pair of control electrodes 24 are centered between the pair of sustainer electrodes 22. The electrode pairs 22 and 24 are formed by a conventional process. In the preferred embodiment, the electrode pairs 22 and 24 are thin film electrodes prepared from evaporated metals such as Au, Cr and Au, Cu and Au, Cu and Cr, ITO and Au, Ag, or Cr and the like.

A uniform charge storage film 26 such as a dielectric film of a type well known in the art covers the electrode pairs 22 and 24 by a variety of planar techniques well known in the art of display manufacture. The charge storage film 26 may be of most any suitable material, such as a lead glass material. In the preferred embodiment, the charge storage film 26 is covered by a thin electron emissive layer 27 The electron emissive layer 27 may be formed from most any suitable material, such as diamond overcoating, MgO, or the like. As will be explained below, the electron emissive layer 27 may be uniform or patterned.

As shown in FIG. 1, the bottom substrate 14 supports an intermediate glass layer 30 which is disposed between the top and bottom substrates 12 and 14. The intermediate layer 30 has a plurality of parallel microgrooves 32 formed therein which are generally perpendicular to the sustaining and control electrode pairs 22 and 24. The microgrooves 32 are separated by barrier ribs 34 which extend in an upward direction in FIG. 1. The upper end of each of the barrier ribs 34 contacts the electron emissive layer 27 which is deposited upon the lower surface 16 of the top substrate 12. Alternately, the microgrooves 32 and barrier ribs 34 can be etched directly into the upper surface of the bottom substrate 14 (not shown). Whichever process is utilized, the microgrooves 32 and barrier ribs 34 are preferably formed from an etchable glass material which is inherently selectively crystallizing, such as, a glass-ceramic composite doped with suitable nucleating agents.

Address electrodes 36 are deposited along the base and surrounding sidewalls of each microgroove 32. The address electrodes 36 are deposited along the base and surrounding sidewalls to increase uniformity of firing and provide optimum phosphor coating along the entire surface of the microgroove 32. The address electrodes 36 are deposited by selectively metalizing a thin layer of Cr and Au or Cu and Au, or Indium Tin Oxide (ITO) and Au, or Cu and Cr, or Ag or Cr within the micrgroove surfaces. The metalization may be accomplished by thin film deposition, E-beam deposition or electroless deposition and the like as well known in the art. Because the microgrooves 32 are generally perpendicular to the electrode pairs 22 and 24, the address electrodes 36 co-operate with the sustaining and control electrode pairs 22 and 24 to define an orthogonal electrode matrix.

Instead of microgrooves, it will be appreciated that the invention also can be practiced utilizing micro-voids (not shown) formed by creating wells on the surface of the bottom substrate over and aligned with the sustaining and control electrode pairs 22 and 24. The non-voided surface areas form barrier ribs perpendicular to the sustaining and control electrode pairs 22 and 24 and divider ribs parallel to and separating the sustaining and control electrode pairs 22 and 24. Alternately, parallel barrier ribs can be formed on the surface of the bottom substrate over and aligned with address electrodes to form the micro-voids, as disclosed in U.S. patent application No. 09/259,940, which is referenced above.

A phosphor material 38 is deposited over at least a portion of each address electrode 36. In a preferred embodiment, the phosphor material 38 is deposited by electrophoresis as well known in the art. The phosphor material is of a type well known in the art and for a full color display red, green and blue phosphors are separately deposited in an alternating pattern to define individual pixels. The resolution of the PDP 10 is determined by the number of pixels per unit area.

Additional details of the structure of the PDP 10 are given in the above referenced U.S. Pat. No. 5,723,945.

The channels 32 are filled with a proportioned mixture of two or more ionizable gases which produces sufficient UV radiation to excite the phosphor material 38. In the preferred embodiment, a gas mixture of neon and from about five to 20 percent by weight of xenon and helium is used.

The sustaining, control and address electrodes are externally connected to conventional plasma display panel driving circuitry (not shown).

The operation of the PDP 10 will now be described. Generally, a discharge is initiated between a selected pair of control electrodes 24 by applying a control voltage across the electrodes. Because the control electrodes are relatively close together, the control voltage needed to initiate the discharge is less than the voltage required to initiate a discharge between the sustaining electrodes.

The establishment of a discharge between a pair of control electrodes 24 functions as a primer for establishing a discharge between the associated pair of sustaining electrodes 22. Once a discharge is initiated between a pair of sustaining electrodes 22, the discharge can be sustained by applying an alternating voltage to the electrode pair 22 and further controlled by applying voltages to selected address electrodes 36, as described in U.S. Pat. No. 5,692,983, which is referenced above.

Figure 3A:
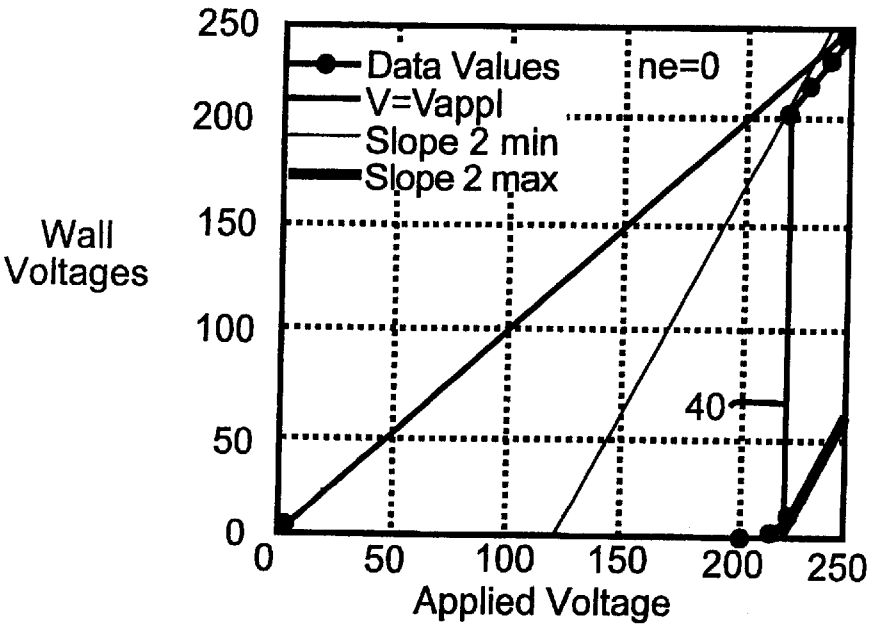
FIG. 3 illustrates the operation of the plasma display panel shown in FIG.
Figure 3B:
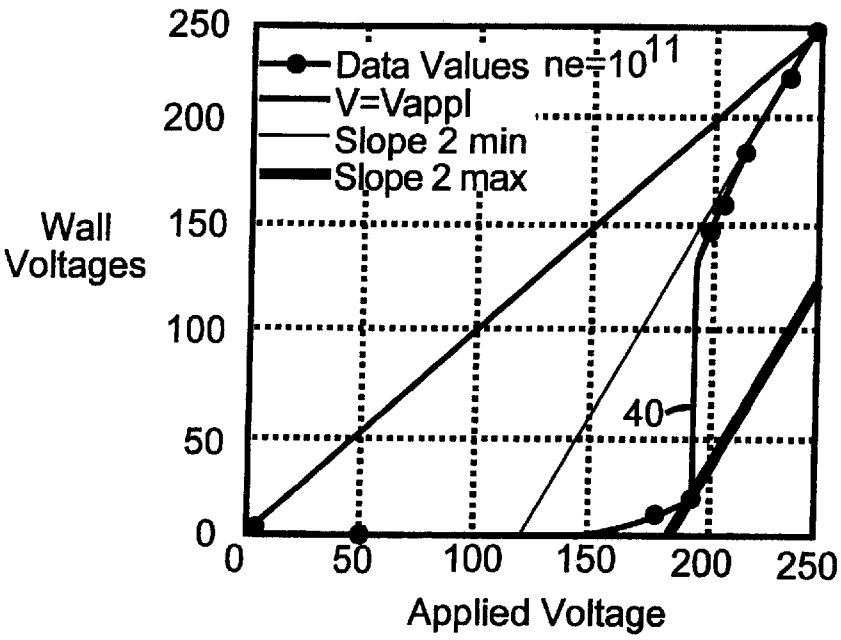
Figure 3D:
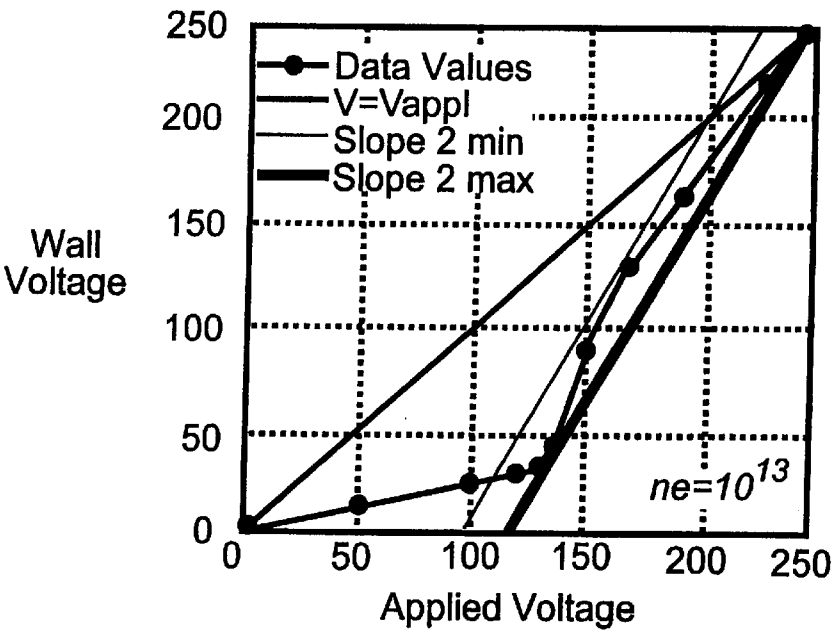
Figure 3C:
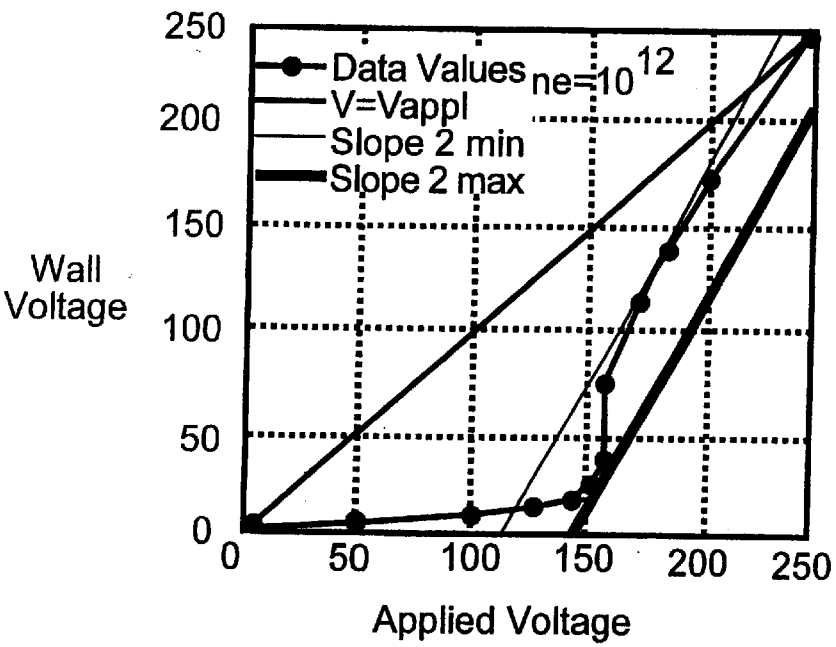

The control electrodes 24 inject a "starting" charge of ne (number of electrons) into the volume between the associated sustaining electrodes 22. The starting charge ne is a function of the voltage applied to and the spacing between the control electrodes 24. The effect of the control electrodes is illustrated by the graphs shown in FIGS. 3A through 3D. In the graphs, the horizontal axis is the voltage applied across the sustaining electrodes 22, while the vertical axis is the resulting voltage appearing across the walls of the microgrooves 32, which is directly proportional to the charge deposited thereon. In FIG. 3A, the starting charge is zero, which corresponds to zero voltage applied to the control electrodes 24, or a PDP which does not have control electrodes. The curve labeled 40 represents the transfer characteristic of the PDP 10. As a voltage applied to the control electrodes, as illustrated in FIG. 3B, and progressively increased, as illustrated in FIGS. 3C and 3D where the starting charge increases from $10^{11}$ to $10^{13}$, the sustaining voltage required for a given wall voltage decreases. For example, for a wall voltage of 100 volts, the sustaining voltage decreases from about 220 volts in FIG. 3A to about 150 volts in FIG. 3D due to the use of the control electrodes 24.

Figure 4:
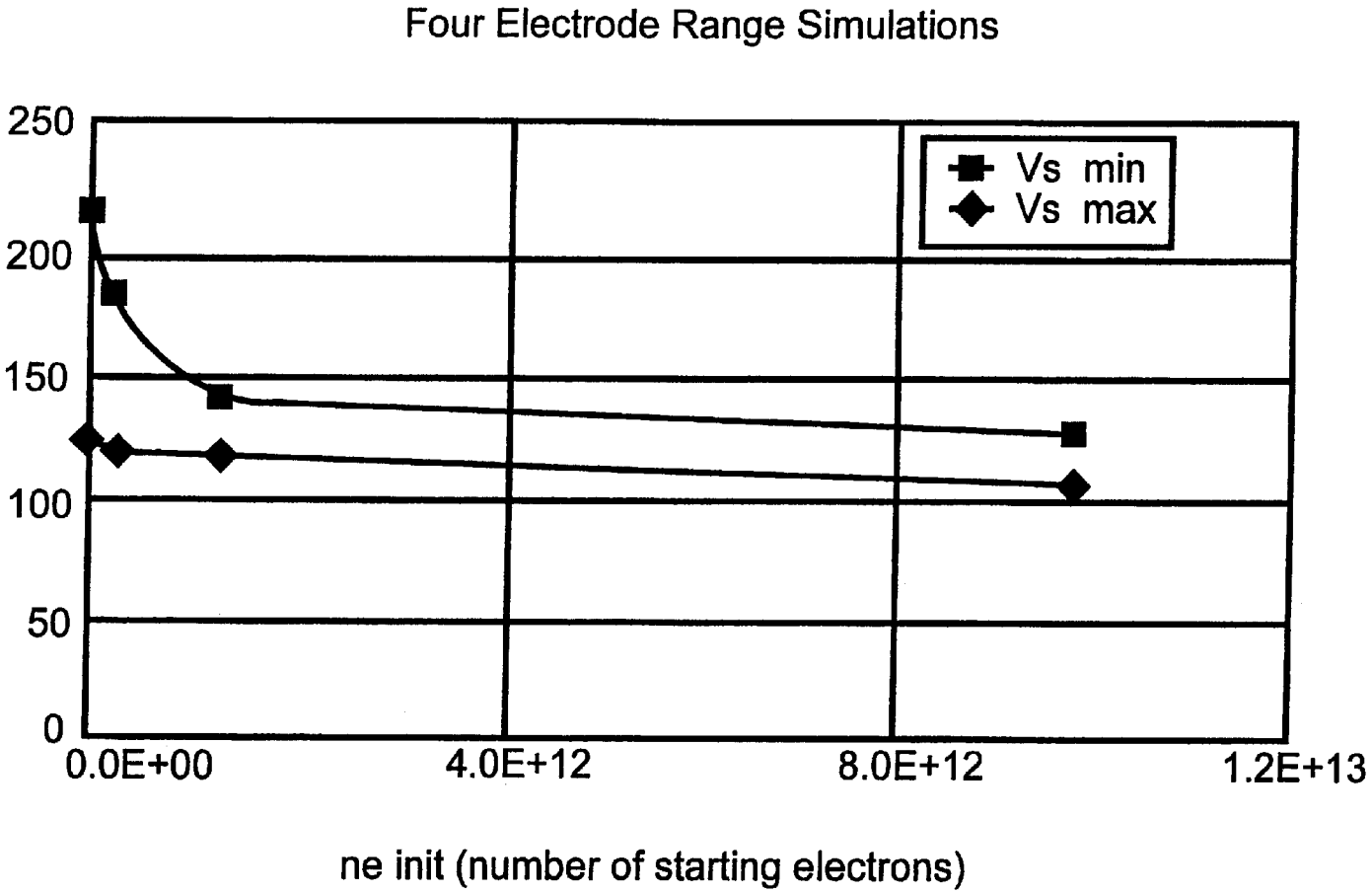
FIG. 4 also illustrates the operation of the plasma display panel shown in FIG. 1.

The geometry of a discharge cell which has a high efficiency, often due to a relatively long discharge path, tends to also have a very high firing voltage. Because the control electrodes 24 enable operation of the PDP 10 at lower sustaining voltages, as illustrated in FIG. 4, a compromise between high efficiency and practical operating voltage is achieved, and the overall power required to operate the PDP 10 is reduced. In FIG. 4, the horizontal axis represents the magnitude of the starting charge ne established by the control electrodes while the vertical axis represents the corresponding voltage needed to sustain a discharge between the sustaining electrodes 22. The vertical axis also represents zero ne, or a PDP without control electrodes. Minimum and maximum bounds are shown in FIG. 4 and, clearly, the magnitude of the sustaining voltage is reduced as the starting charge is reduced by the control electrodes 24.

Figure 5:
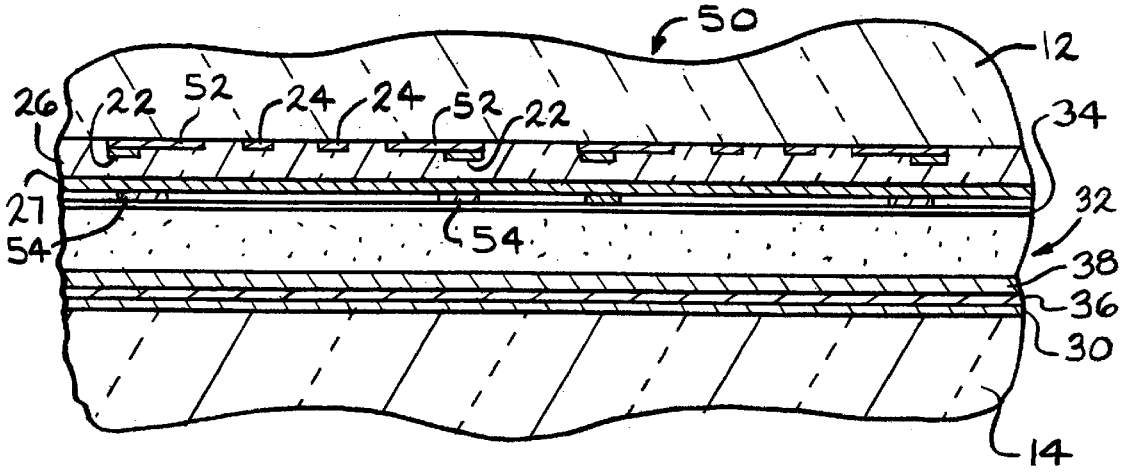
FIG. 5 is a sectional view of an alternate embodiment of the plasma display panel shown in FIG. 1.

While the preferred embodiment of the invention has been illustrated and described above, it will be appreciated that the invention also can be practiced with alternative PDP's. For example, an alternate embodiment of the PDP which incorporates the invention is illustrated generally at 50 in FIG. 5, where components which are similar to components shown in FIGS. 1 and 2 have the same numerical designators. In FIG. 5, each of the sustaining electrodes 22 includes an associated extension electrode 52. Also, a plurality conductive charge storage pads 54 are disposed upon the lower surface of the electron emissive layer 27. The extension electrodes 52 and conductive storage pads 54 increase the efficiency of the PDP 50 are described in the above referenced U.S. patent application Ser. No. 09/259,940.

Figure 6:
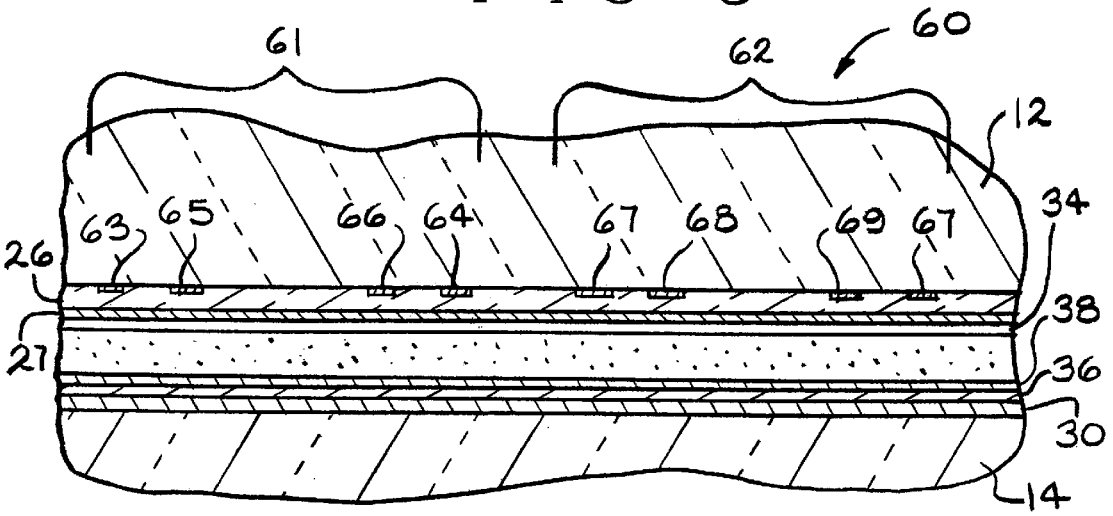
FIG. 6 is a sectional view of another alternate embodiment of the plasma display panel shown in FIG. 1.

Another alternate embodiment of the invention is shown generally at 60 in FIG. 6. As above, components of the PDP 60 which are similar to components shown in FIGS. 1 and 2 have the same numerical designators. As before, two sets of parallel electrodes, 61 and 62, are shown deposited upon the lower surface of the top substrate 12. The first set of electrodes 61 includes a pair of sustaining electrodes 63 and 64. A first control electrode 65 is disposed adjacent to the left sustaining electrode 63. In the preferred embodiment, the first control electrode 65 is separated from the left sustaining electrode 63 by about 40 microns to 100 microns. Similarly, a second control electrode 66 is disposed adjacent to the right sustaining electrode 64. In the preferred embodiment, the second control electrode 66 is separated from the right sustaining electrode 64 by about 40 microns to 100 microns. Similarly, the second set of electrodes 62 includes a pair of sustaining electrodes 67 having first and second control electrodes 68 and 69 disposed adjacent thereto.

The operation of the PDP 60 will now be described with reference to the first set of electrodes 61 in FIG. 6. Initially, a control voltage is applied to the first control electrode 65 which establishes a starting charge of electrons between the first control electrode 65 and the left sustaining electrode 63. The charge electrons may be the result of a relatively small discharge between the control electrode 65 and a sustaining electrode 63. The starting charge enables establishment of a relatively larger discharge between the sustaining electrodes 63 and 64 with a lower sustaining voltage than would be needed in the absence of the starting charge. Additionally, it is normally desired that the sustaining electrode 63 be a cathode with respect to the control electrode 65 at this phase of the operation.

As indicated above, the PDP 60 is an AC device. Accordingly, as the applied alternating sustaining voltage passes through zero at the end of the first half cycle of the AC voltage cycle, an initial control voltage is applied to the second control electrode 66 and the control voltage applied to the first control electrode 65 is returned to its initial voltage. The control voltage establishes a starting charge of electrons between the second control electrode 66 and the right sustaining electrode 64. As the sustaining voltage increases in the opposite direction during the second half of the AC voltage cycle, a discharge is reestablished between the sustaining electrodes 63 and 64. Again, the starting charge enables establishment of a discharge between the sustaining electrodes 63 and 64 with a lower sustaining voltage than would be needed in the absence of the starting charge. During this phase of the operation, care is taken so that no discharge or starting electrons are produced at the site of the control electrode 65, as it is desired that the sustaining electrode 63 functions as an anode. This can be accomplished by appropriate waveform timing, or, as will be explained below, by utilizing materials having different gammas to form the electron emissive layer 27. The second set of control electrodes 68 and 69 cooperate with the second set of sustaining electrodes 67 in the same manner to establish a discharge between the sustaining electrodes 67.

Figure 7:
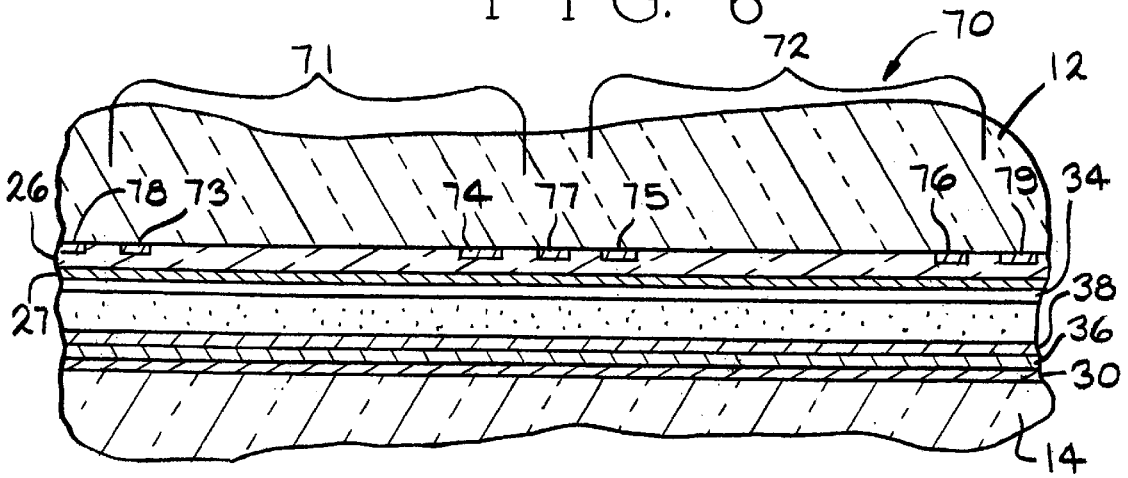
FIG. 7 is a sectional view of another alternate embodiment of the plasma display panel shown in FIG. 1.

Another alternate embodiment of the invention is shown generally at 70 in FIG. 7. As above, components of the PDP 70 which are similar to components shown in FIGS. 1 and 2 have the same numerical designators. Two pairs of sustaining electrodes. 71 and 72, are shown deposited upon the lower surface of the top substrate 12. The first pair of sustaining electrodes 71 includes a left sustaining electrode 73 and right sustaining electrode 74. Similarly, the second set of sustaining electrodes 72 includes a left sustaining electrode 75 and a right sustaining electrode 76. In the embodiment 70 shown in FIG. 7, the control electrodes are disposed between the pair of sustaining electrodes. Thus a single control electrode 77 is disposed between the first pair of sustaining electrodes 71 and the second pair of sustaining electrodes 72. A second control electrode 78 is shown at the left of FIG. 7 and is disposed between the first pair of sustaining electrodes 71 and the next pair of sustaining electrodes to the left in FIG. 7 (not shown). Similarly, a third control electrode 79 is shown at the right of FIG. 7 and is disposed between the second pair of sustaining electrodes 72 and the next pair of sustaining electrodes to the right in FIG. 7 (not shown).

The operation of the PDP 70 will now be explained. Adjacent pairs of sustaining electrodes are excited with AC voltages having opposite polarities. Accordingly, an initial control voltage is applied to the common control electrode 77. The initial control voltage establishes two sets of starting charges. A first staring charge extends from the control electrode 77 to the left in FIG. 7 to the right sustaining electrode 74 in the first sustaining electrode pair 71, and a second starting charge extends from the control electrode 77 to the right in FIG. 7 to the left sustaining electrode 75 in the second sustaining electrode pair 72. As is the AC voltage applied between the pairs of sustaining electrodes 71 and 72 is increased, a discharge is established therebetween. As described above, the starting charge established by the control electrode 77 enables establishment of the discharge between the sustaining electrode pairs 71 and 72 at a lower value than in the absence of the control electrode. As the alternating sustaining voltage passes through zero at the end of the first half of the AC voltage cycle, an initial control voltage is applied to the second and third control electrodes 78 and 79 while the control voltage applied to the first control electrode 77 is reduced to zero. The second and third control electrodes 78 and 79 cooperate with the adjacent sustaining electrodes 73 and 76, respectively, to establish starting charges therebetween. As the sustaining voltage continues to increase in the opposite direction, discharges are reestablished between the sustaining electrode pairs 71 and 72. The control electrodes 78 and 79 are also cooperating with sustaining electrodes (not shown) to the left of the second control electrode 78 and to the right of the third control electrode 79 to establish starting charges therebetween.

Figure 8:
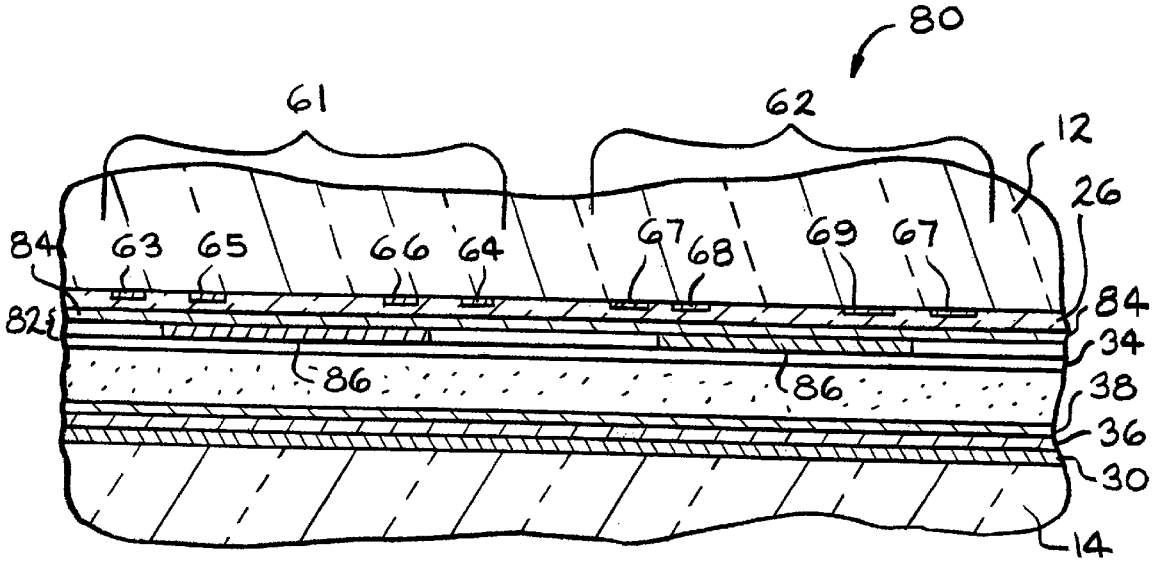
FIG. 8 is a sectional view of an alternate embodiment of the plasma display panel shown in FIG. 6.

It has been found that there is a further advantage when the gamma of the electron emissive layer is greater over the sustaining electrode 63 relative to the gamma of the electron emissive layer over the control electrode 65. This assures that the sustaining electrode 63 functions as a cathode with respect to the sustaining electrode 65. Accordingly, the present invention contemplates an alternate embodiment of the PDP 60 which is shown generally at 80 in FIG. 8. Components of the PDP 80 which are similar to components shown for the PDP 60 have the same numerical designators. The PDP 80 includes an electron emissive layer 82 formed from two materials having different gammas. A first layer electron emissive material 84 having a first gamma is deposited over the entire surface of the charge storage film 26. A second layer of electron emissive material 86 having a second gamma is deposited over portions of the first layer 84 adjacent to the control electrodes 65, 66, 68 and 69. The second layer 86 can be formed by completely covering the first layer 84 and then etching away the portions of the second layer 86 which are adjacent to the sustaining electrodes 63, 64 and 67. In the preferred embodiment the first layer 84 is formed form a material having a gamma greater than the gamma of the second layer 86. Typically, the first layer 84 can be formed from PbO and the second layer 86 can be formed from MgO. Accordingly, the first layer 84 will fire at a lower voltage and function as the cathode described above.

Figure 9:
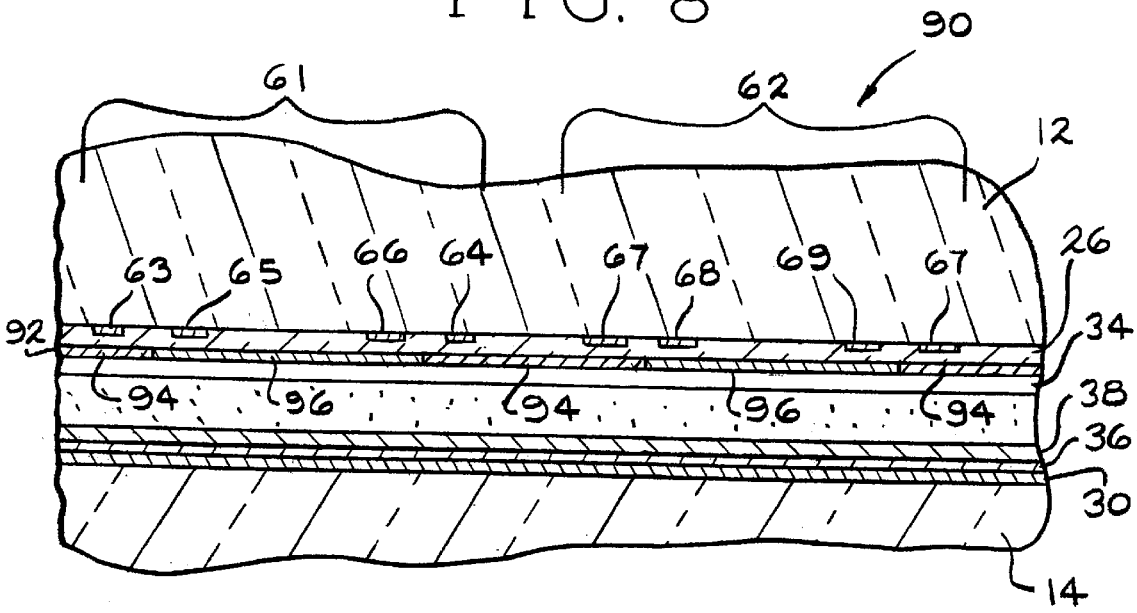
FIG. 9 is a sectional view of an alternate embodiment of the plasma display panel shown in FIG. 8.

An alternate embodiment of the PDP 80 is generally shown at 90 in FIG. 9, where similar components have the same numerical designators. The PDP 90 has an electron emissive layer 92 formed from a first electron emissive material 94 having a first gamma alternating with a second electron emissive material 96 having a second gamma.

While the preferred embodiments of the PDP's 60, 70, 80 and 90 have been illustrated and described above, it will be appreciated that the extension electrodes 52 and conductive storage pads 54 shown in FIG. 5 can be included in the PDP's 60, 70, 80 and 90. Additionally, the patterned electron emissive layers 82 and 92, respectively, illustrated in FIGS. 8 and 9 also may be applied to the examples of PDP's shown in FIGS. 2 and 5 through 7.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A plasma flat-panel display comprising:

a first transparent substrate;

at least one pair of parallel sustaining electrodes deposited upon said first substrate;

at least one control electrode deposited upon said first substrate parallel to and coplanar with said sustaining electrodes, said control electrode being physically displaced and electrically isolated from said sustaining electrodes;

a layer formed from a dielectric material covering said sustaining and control electrodes;

a second substrate which is hermetically sealed to said first substrate, said second substrate having a plurality of micro-voids formed in a surface thereof which is adjacent to said first substrate, said micro-voids generally perpendicular to said sustaining and control electrodes and cooperating with said first substrate to define a plurality of sub-pixels;

a gas filling said micro-voids; and a plurality of address electrodes incorporated within said second substrate, each of said address electrodes corresponding to one of said sub-pixels.

2. A plasma flat-panel display according to claim 1 further including an electron emissive surface layer covering said dielectric layer.

3. A plasma flat-panel display according to claim 2 wherein said electron emissive layer is formed from a first electron emissive material having a first gamma and a second electron emissive material having a second gamma, said first gamma being greater than said second gamma, with said first electron emissive material being adjacent to said sustaining electrodes and said second electron emissive material being adjacent to said control electrode, such that at least one of said sustaining electrodes will preferentially function as a cathode relative to said control electrode.

4. A plasma flat-panel display according to claim 2 further including a phosphor material deposited within each micro-void and associated with said address electrodes.

5. A plasma flat display panel according to claim 4 wherein said pair of parallel sustaining electrodes is a first pair of sustaining electrodes and further wherein a second pair of parallel sustaining electrodes is deposited upon said first substrate parallel to said first pair of sustaining electrodes with said control electrode disposed between said first and second pair of sustaining electrodes.

6. A plasma flat display panel according to claim 4 wherein said control electrode is a first control electrode and further wherein a second control electrode is deposited upon said first substrate parallel to said sustaining electrode, said first and second control electrodes being disposed between said sustaining electrodes.

7. A plasma flat display panel according to claim 6 wherein said first and second control electrodes are centered between said sustaining electrodes.

8. A plasma flat-panel display according to claim 7 wherein the spacing of said control electrodes is within the range of 100 to 400 microns.

9. A plasma flat display panel according to claim 6 wherein said first control electrode is adjacent to one of said sustaining electrodes and said second control electrode is adjacent to the other of said sustaining electrodes.

10. A plasma flat-panel display according to claim 4 further including a layer of insulating film deposited upon said surface of said electron emissive layer and at least one electrically conductive surface pad located upon the surface of said insulating film in association with a corresponding sustaining electrode.

11. A plasma flat-panel display according to claim 4 further including a plurality of pairs of sustaining electrodes, each pair of sustaining electrodes having a pair of control electrodes associated therewith, said micro-voids in second substrate cooperating with said first substrate to define a plurality of sub-pixels which form rows parallel to said sustaining and control electrodes and columns which are perpendicular to said sustaining and control electrodes with each of said plurality of address electrodes incorporated within said second substrate corresponding to one column of said sub-pixels.

12. A plasma flat-panel display according to claim 11 wherein said first and second substrates are formed from glass.

13. A plasma flat-panel display according to claim 11 wherein said second substrate includes a layer having said micro-voids formed therein mounted upon a base portion.

14. A plasma flat-panel display according to claim 13 wherein said micro-voids are microgrooves.

15. A method of operating a plasma flat-panel display comprising the steps of:

(a) providing a display including a first transparent substrate having at least one pair of parallel sustaining electrodes deposited thereupon and at least one control electrode deposited thereupon parallel to and coplanar with the sustaining electrodes with the control electrode being physically displaced and electrically isolated from the sustaining electrodes, a layer formed from a dielectric material covering the sustaining and control electrodes, a second substrate which is hermetically sealed to the first substrate, the second substrate having a plurality of micro-voids formed in a surface thereof which is adjacent to the first substrate, the micro-voids generally perpendicular to the sustaining and control electrodes and cooperating with the first substrate to define a plurality of sub-pixels, a gas filling the micro-voids; and a plurality of address electrodes incorporated within the second substrate, each of the address electrodes corresponding to one of the sub-pixels;

(b) applying a first voltage to the control electrode of sufficient magnitude to inject a charge of electrons between the control electrode and an associated sustaining electrode; and (c) applying a second voltage to the sustaining electrodes to cause a discharge between the sustaining electrodes.

16. A method according to claim 15 wherein the display further includes an electron emissive surface layer covering said dielectric layer.

17. A method according to claim 16 wherein the electron emissive layer is formed from a first electron emissive material having a first gamma and a second electron emissive material having a second gamma, the first gamma being greater than the second gamma, with the first electron emissive material being adjacent to the sustaining electrodes and the second electron emissive material being adjacent to the control electrode, such that at least one of the sustaining electrodes will preferentially function as a cathode relative to the control electrode.

18. A method according to claim 15 further including, subsequent to step (c), applying a third voltage to the address electrodes to control the discharge between the sustaining electrodes.

19. A method according to claim 18 wherein the first and second voltages are alternating voltages.

20. A method of operating a plasma flat-panel display comprising the steps of:

(a) providing a display including a first transparent substrate having at least one pair of parallel sustaining electrodes deposited thereupon and a pair of parallel control electrodes deposited thereupon between and parallel to and coplanar with the sustaining electrodes with the control electrodes being physically displaced and electrically isolated from the sustaining electrodes, a layer formed from a dielectric material covering the sustaining and control electrodes, a second substrate which is hermetically sealed to the first substrate, the second substrate having a plurality of micro-voids formed in a surface thereof which is adjacent to the first substrate, the micro-voids generally perpendicular to the sustaining and control electrodes and cooperating with the first substrate to define a plurality of sub-pixels, a gas filling the micro-voids; and a plurality of address electrodes incorporated within the second substrate, each of the address electrodes corresponding to one of the sub-pixels;

(b) applying a first voltage to the control electrodes of sufficient magnitude to inject a charge of electrons between the associated sustaining electrodes; and (c) applying a second voltage to the sustaining electrodes to cause a discharge between the sustaining electrodes.

21. A method according to claim 20 wherein the display further includes an electron emissive surface layer covering said dielectric layer.

22. A method according to claim 21 wherein the electron emissive layer is formed from a first electron emissive material having a first gamma and a second electron emissive material having a second gamma, the first gamma being greater than the second gamma, with the first electron emissive material being adjacent to the sustaining electrodes and the second electron emissive material being adjacent to the control electrode, such that at least one of the sustaining electrodes will preferentially function as a cathode relative to the control electrode.

23. A method according to claim 21 further including, subsequent to step (c), applying a third voltage to the address electrodes to control the discharge between the sustaining electrodes.

24. A method according to claim 23 wherein the first and second voltages are alternating voltages.

25. A method according to claim 21 wherein the control electrodes are centered between the sustaining electrodes.

26. A method according to claim 21 wherein one of the pair of control electrodes is adjacent to one of the sustaining electrodes and the other of the pair of control electrodes is adjacent to the other of sustaining electrodes.

* * * * *